United States Patent [19]

Conklin et al.

[11] Patent Number: 4,581,986

[45] Date of Patent: Apr. 15, 1986

[54] CONTAMINATION REDUCING AIRLOCK AND ENTRY SYSTEM

[75] Inventors: Keith J. Conklin, DeLand; Charles H. Keck, Jr., Daytona Beach, both of Fla.

[73] Assignee: Brunswick Corporation, Skokie, Ill.

[21] Appl. No.: 589,632

[22] Filed: Mar. 14, 1984

[51] Int. Cl.[4] ..... F24F 7/00

[52] U.S. Cl. ..... 98/1; 49/41; 52/2; 98/31; 98/33.1

[58] Field of Search ..... 52/2; 49/40, 41; 98/1, 98/31, 33 R, 36, 87, 115 LH; 135/93

[56] References Cited

U.S. PATENT DOCUMENTS

| | | | |
|---|---|---|---|
| 1,621,356 | 3/1927 | Dickey | 98/36 |
| 2,360,343 | 10/1944 | Hill | 98/33 R |
| 3,097,587 | 7/1963 | Kurek | 98/36 |
| 3,294,480 | 12/1966 | Potapehko | 98/33 R X |
| 3,302,547 | 2/1967 | Wasserman | 98/33 R |
| 3,363,532 | 1/1968 | Horneff | 98/33 R |
| 3,367,257 | 2/1968 | Raider et al. | 98/33 R |
| 3,687,053 | 8/1972 | Henson et al. | 98/33 R |
| 3,766,844 | 10/1973 | Donnelly et al. | 98/33 R |
| 3,875,927 | 4/1975 | Trexler | 98/36 |

FOREIGN PATENT DOCUMENTS

| | | | |
|---|---|---|---|
| 2301991 | 7/1974 | Fed. Rep. of Germany | 52/2 |
| 53-27244 | 3/1978 | Japan | 52/2 |
| 1058436 | 2/1967 | United Kingdom | 52/2 |
| 800508 | 1/1981 | U.S.S.R. | 98/36 |

*Primary Examiner*—Harold Joyce

*Attorney, Agent, or Firm*—William G. Lawler, Jr.; George J. Porter

[57] ABSTRACT

An airlock (purge chamber) which functions as an intermediate area between a contaminated area and a clean area where contaminated air may be purged before a person enters the clean area. The airlock (10) is a double-walled circular structure having an outside wall (20) with a single air intake (31) at its top and multiple air discharge ducts (37) spaced around the full 360 degree circumference of its base. The airlock (10) has an inner wall (24) with multiple air intake openings (perforations) (38) across its inner ceiling (26) and around its sides (24), providing a primary purge air flow (34) into the ceiling (26) of the inner wall (24) and down through the airlock (10) and a secondary air flow (32) into the side air intake openings (perforations) (38) and down through the airlock (10). Outgoing purge air (36) flows down through the floor (28) of the inner wall (24) and out the discharge ducts (37) at the base (27) of the outer wall (20) of the airlock (10).

9 Claims, 6 Drawing Figures

CONTAMINATION REDUCING AIRLOCK AND ENTRY SYSTEM

TECHNICAL FIELD

The present invention relates generally to airlocks or purge chambers and more particularly to an airlock having a separate exit and separate entrance way allowing quick entry or exit into a chamber from the airlock without allowing contaminated air to get into the clean area.

BACKGROUND OF THE INVENTION

Today there are many requirements for "clean rooms" or clean areas which are free from dust or free from many other kinds of contaminants. Clean rooms or non-contaminated areas are needed to provide enclosed space which is: (1) free of bacteria for operating rooms, (2) free of contaminants or dust for use in industry for special manufacturing requirements, or (3) free of biological, chemical, and nuclear fallout contaminants for noncontaminated areas or structures used by the military services.

Airlocks or purge chambers are usually arranged so that a person or persons may enter the airlock, close the door, and remain there while fans provide a change of air. Then, when the air is sufficiently clean, the person or persons may open the door into the inner chamber or clean room and enter it without also allowing contaminated air to enter this inner chamber. However, there is much room for improvement and increased efficiency in the design of existing airlocks. One big drawback in existing designs is that airlocks, like most other conventional rooms or enclosures in buildings, are usually shaped so as to have a rectangular or square floor plan. Examples of such airlocks are those shown in U.S. Pat. Nos. 3,766,844 to DONNELLY, et al., 4,137,831 to HOWORTH, and 4,375,735 to RHOADS. Ideally, an airlock would function best with perfect mixing of the purge airstream and the contaminated air. Because of the rectangular or square cross sections of these airlocks, however, high contamination levels can continue to exist near the walls and in the corner of the airlock. The net result is a long period of time to purge an airlock of contamination. An additional problem is in the door designs. Airlocks in use today have doors that are either hard to use or can cause excessive amounts of contamination to enter the airlock.

Another type of airlock structure is shown in U.S. Pat. Nos. 3,501,213 and 3,576,206 to TREXLER. This type of airlock has a complex design providing a sterile locker or anteroom with a pair of entrances which are sealed by troughs or reservoirs of fluid. This arrangement appears to be effective but also is heavy and expensive to build. Obviously, it would not be suitable for a portable airlock.

A type of prior art device which functions to prevent contamination of a clean room is an air-curtain installation. Examples of this type of device are shown in U.S. Pat. Nos. 3,608,468 to McCLURKIN and 4,074,620 to JANSSON. These devices provide an air curtain or air barrier in a doorway or opening in a wall to prevent air flow through the opening. They appear useful for preventing cold air from entering a heated area but do not appear to be highly effective in preventing contamination of a clean room or a noncontaminated area. They also have the disadvantage of being expensive, heavy, and not suitable where a portable airlock device is needed.

U.S. Pat. No. 4,438,966 to HASTINGS discloses a round circular booth. However, this device is used to provide security, namely, a secure transaction interface with another room where money, valuables, or secure information are kept. This patent does not disclose or suggest a system capable of removing contaminated air from the booth in order to prevent contamination of the inner room.

It is, therefore, a general object of this invention to provide a more efficient method and apparatus for personnel entry/exit into and from a structure that operates in an ambient environment contaminated by toxic chemical agents while providing a clean, noncontaminated environment to the personnel inside the structure. It is another object of the invention that this entry/exit must be accomplished as expeditiously as possible without introducing the contamination from the exterior ambient environment into the protective structure.

SUMMARY OF THE INVENTION

The present invention is suitable for a wide variety of industrial, business, or military uses where a highly effective yet quickly erectible portable airlock is needed to prevent clean rooms or noncontaminated areas from becoming contaminated by dust, chemical agents, biological agents, or nuclear fallout. The airlock was designed for use with sturdy portable shelters of the type disclosed in U.S. patent applications Ser. No. 480,230, "Expandable Shelter System Providing Collective Protection," filed Mar. 30, 1983, or Ser. No. 525,001, "Expandable Soft Side Shelter," filed Aug. 19, 1983. However, as mentioned above the airlock may be used in permanent buildings as well as with portable shelters.

In accordance with the invention, there is provided a portable airlock structure comprising a double-walled circular airlock having an outside wall with a single air intake at its top and multiple air discharge ducts spaced around the full 360 degree circumference of its base. The airlock has an inside wall with multiple air outlet openings across its top and around its sides, providing a primary air flow into the top of the inner wall and down through the airlock and a secondary air flow into the side air intake openings and down through the airlock. Air flows down through the floor of the inner wall and out the discharge ducts at the base of the outer wall of the airlock.

BRIEF DESCRIPTION OF THE DRAWINGS

A presently preferred embodiment of the invention will now be described in detail in connection with the accompanying drawings wherein.

DETAILED DESCRIPTION OF THE INVENTION

Figure 1:
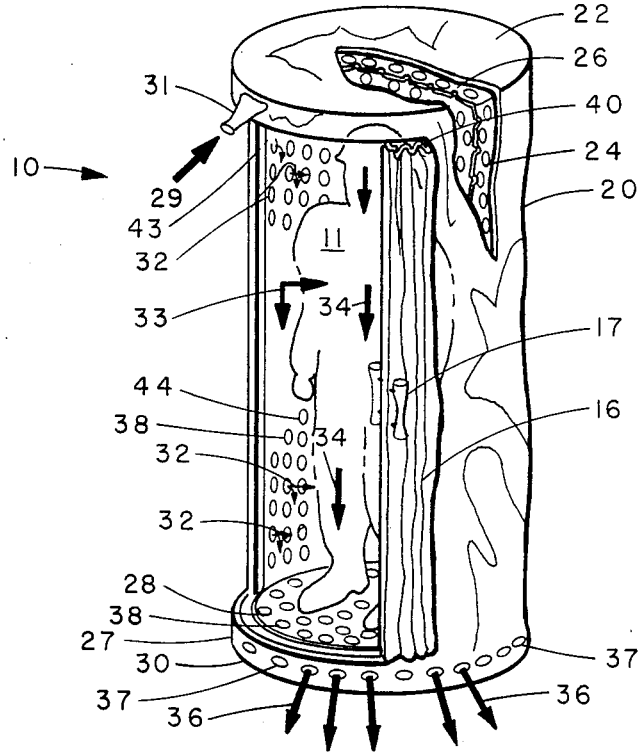
FIG. 1 is a perspective view of the preferred embodiment of the airlock which has folding fabric doors.

FIG. 1 is a perspective view showing a preferred embodiment of the invention, a circular portable airlock indicated generally by numeral 10. Airlock or purge chamber 10 is designed to be used when a person 11 goes from a chemically or biologically (to include bacterium, viruses, spores, toxins, etc.) contaminated area 14 or other contaminated environments to a noncontaminated (clean) area 18 and also when the person 11 reverses direction and exits the noncontaminated area 18. Airlock 10 has two exit/entrances, an outer door 12 with handle 13 leading to the contaminated area and an inner door 16 with handle 17 leading to the noncontaminated area 18. Airlock 10 has an outer wall 20, outer ceiling 22, an inner wall 24, an inner ceiling 26, an inner floor 28, and an outer floor 30.

Figure 2:
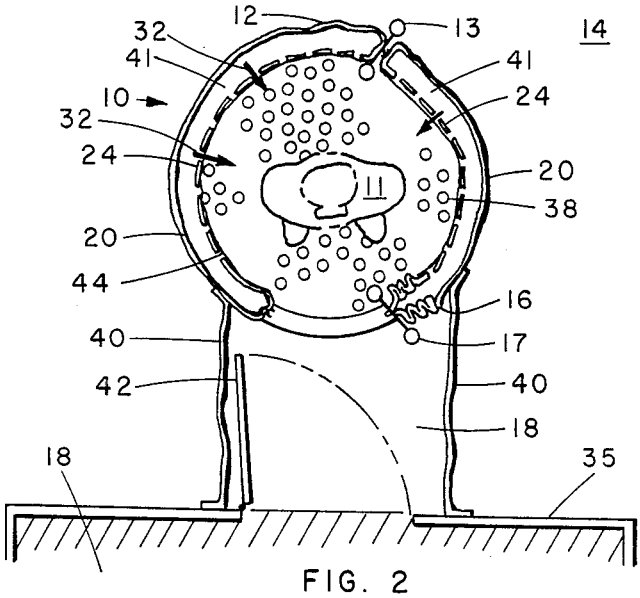
FIG. 2 is a plan view of the airlock shown in FIG. 1, with attached entrance way connected to a portable shelter or clean room.

In the plan view of FIG. 2, shelter 10 is shown connected to a portable shelter 35 by use of a portable passageway 40. Hinged door 42 in the end of shelter 35 leads into passageway 40.

To use the airlock 10, a person 11 opens the outer door 12 to the airlock 10, enters airlock 10 from the contaminated area 14, stands on inner floor 28, closes the door 12, waits inside airlock 10 until it is purged of contaminated air, opens the door 16 to the noncontaminated area 18, enters the noncontaminated area 18, and closes the door to the airlock 10.

The time required to purge an airlock of contamination can be mathematically predicted, assuming perfect mixing of the purge airstream and the contaminated air in the airlock. In the design of the present invention, consideration was given to achieving a significant reduction in purge time by causing the purge airstream 29 (from an air source not shown) entering the clean air entrance duct 31 of airlock 10 to push out the contaminated air rather than mixing the two airstreams. This is achieved by moving the laminar layer of air 33 next to the wall toward the center of the airlock 10 and bringing a curtain of primary purge air 34 from the top of the airlock 10 to the bottom. The result is that the air 36 exiting the airlock 10 through exit ducts 37 has a higher concentration of contaminants than would be the case if the air in airlock 10 contained an average concentration of contaminants (as may be calculated, assuming perfect mixing).

Shifting the concentration level to cause a high concentration of contaminants in the exiting air 36 is achieved by bleeding secondary purge air 32 through a large plurality of perforations 38 in inner wall 24 and simultaneously moving the curtain of primary purge air 34 out of the airlock 10 by evenly distributing purge air 34 over the cross section of airlock 10 and removing purge air 36 through perforations 38 in inner floor 28 in the same even manner. Purge air 36 then exits the bottom of airlock 10 through exit ducts 37, which are spaced around the base 27 of the outer wall 20.

The circular shape of the airlock 10 serves two purposes. First, it eliminates the "corner" effect which can cause high concentrations of contamination to remain in the airlock 10 after theory predicts a reduction of the contamination level. Second, it provides an even movement of the secondary purge air 32 from inner wall 24 toward the center of the airlock 10.

Figure 4:
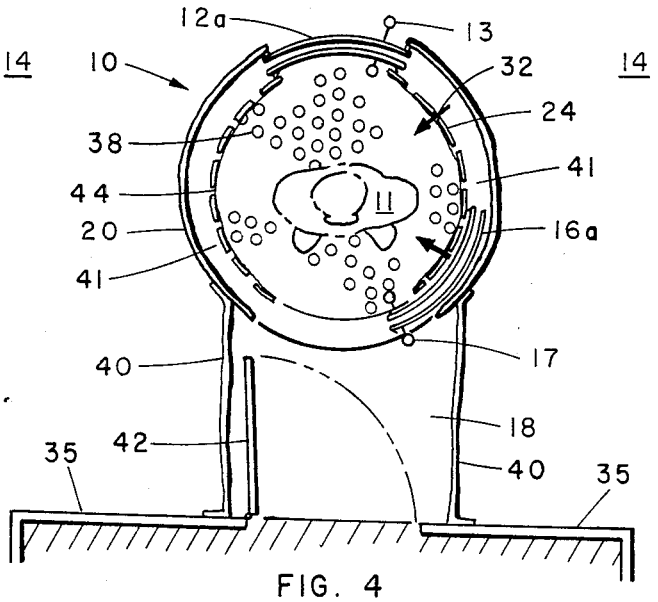
FIG. 4 is a plan view of the airlock shown in FIG. 3, with attached entrance way connected to a portable shelter or clean room.
Figure 3:
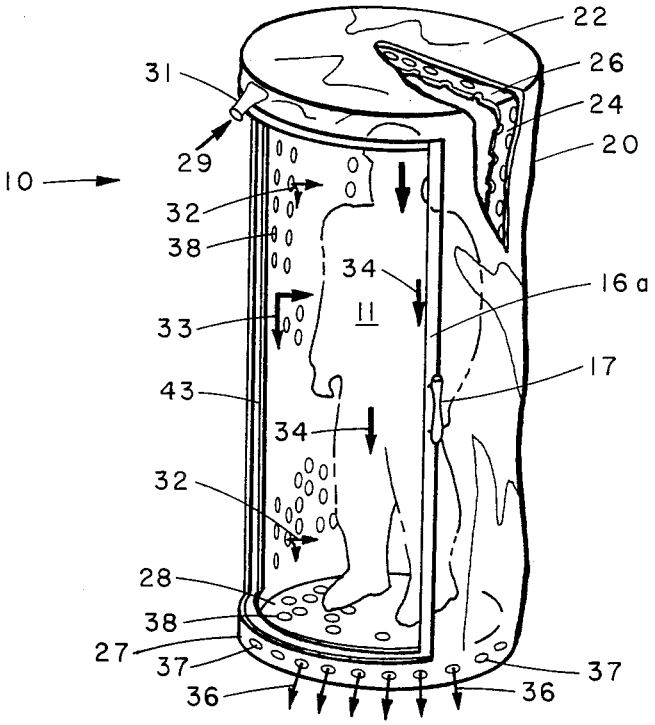
FIG. 3 is a perspective view of an airlock which is an alternative embodiment of the invention, using sliding doors.
Figure 6:
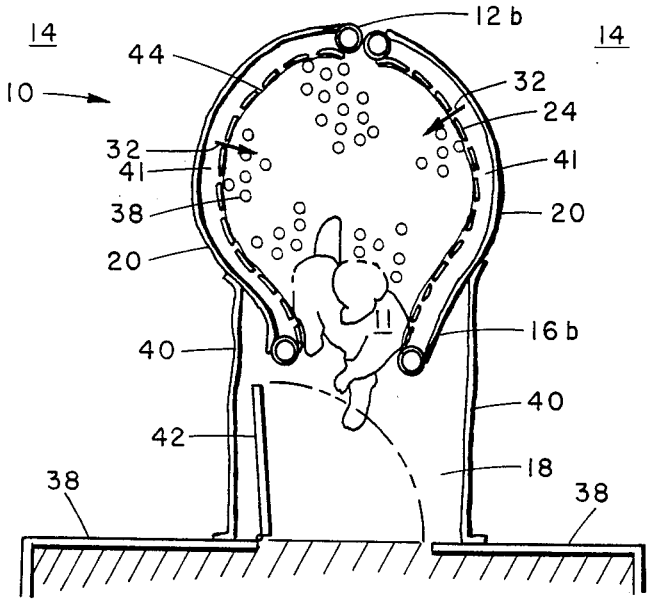
FIG. 6 is a plan view of the airlock shown in FIG. 5 with attached entrance way connected to a portable shelter or clean room.
Figure 5:
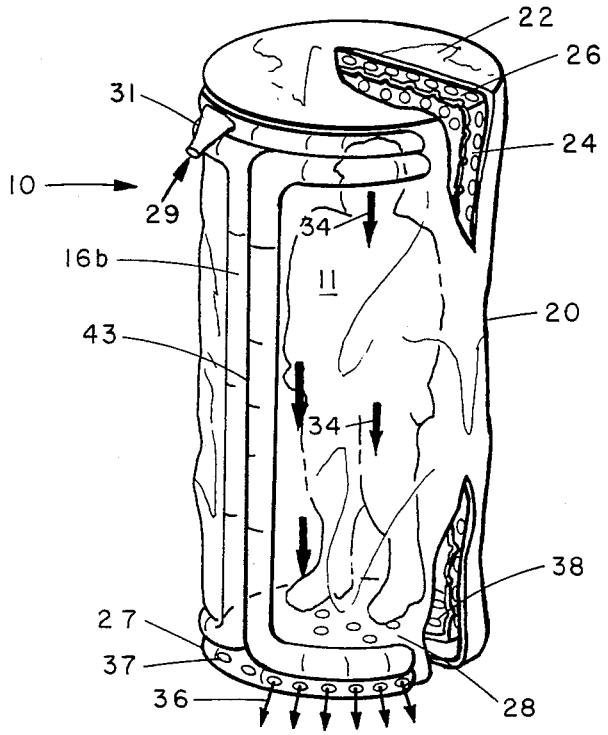
FIG. 5 is a perspective view of an airlock which is an alternative embodiment of the invention, using high pressure air-biased doors.

Moving the contaminated air toward the center of the airlock 10 in a uniform fashion is achieved by causing the door 16 to bleed purge air 34 into the airlock 10 at the same rate as the purge air 32 bleeds through the inner side wall 24. Airlock 10 may be equipped with folding doors (FIGS. 1 and 2), sliding doors (FIGS. 3 and 4), or pocket doors (FIGS. 5 and 6). The folding door 16 and sliding door **16*a* have elastic seals at the top and bottom and the purge air 32 enters from the side wall 24. The pocket door 16*b* is sealed on three sides and purge air 32 enters from the side wall 24. Doors 16, 16*a*, and 16*b* are sealed at the airlock wall interface 43 to prevent purge air 34** from leaking by the doors and upsetting the air balance.

Non-rigid entrances 16 and **16*b* use high pressure purge air 32 in the double wall area 41 to support the airlock; frame supports (not shown) may also be used. The purge air 32 will bleed through a high resistance membrane 44 covering perforations 38 in the inner side wall 24, thereby creating high pressure walls for support of airlock 10. Bleed air 32 moves the laminar layer of air 33 near the wall 24 to the center of the airlock 10**.

The entering purge air 32 and 34 is distributed evenly across the cross section of the airlock by a membrane 44 in a manner similar to current airlocks. The exit of the purge air 36 is different in that it uses a grate to distribute the rate of flow out of the airlock 10 evenly across the entire cross section of airlock 10. A plenum beneath the grate will give a uniform velocity to the exiting purge air 36.

From the above description, it may be seen that the present invention is an airlock which functions in a highly efficient manner to provide a rapid change of air within the airlock. This in turn provides the possibility for a person to rapidly move from a contaminated area, into the airlock, and, after a rapid change of air, on into the clean area. The movement of purge air in two directions, (1) down through the airlock and also (2) down between the walls, through the perforations of the inner wall and on down through the airlock, contribute to highly efficient movement of the purge air, so that the clean air tends to push out the contaminated air, rather than mixing with it. The circular shape of the airlock eliminates the "corner effect" which can trap contaminated air in the airlock instead of keeping the contaminated air moving.

What is claimed is:

1. A contamination reducing airlock and entry system, configured and arranged to connect with a non-contaminated area to allow one person to enter said airlock and entry system and to wait while contaminated air is purged from said system before entering said non-contaminated area, comprising:

an outside enclosure, said outside enclosure being circular in cross section and of sufficient height and diameter to accommodate at least one person in the standing position, said outside enclosure comprising:

an outside wall;

an outside ceiling attached to the top of said outside wall;

an outside floor attached to the bottom of said outside wall; and means connected to said outside wall for allowing clean air to enter said outside enclosure and contaminated air to exit said outside enclosure;

an inside enclosure, said inside enclosure being configured so as to fit inside said outside enclosure in spaced proximity thereto, said inside enclosure being circular in cross-section and of sufficient height and diameter to accommodate at least one person in the standing position, said inside diameter comprising;

an inside wall;

an inside ceiling attached to the top of said inside wall; and and inside floor attached to the bottom of said inside wall;

said inside wall, said inside ceiling and said inside floor each having at least one opening connecting said inside enclosure to said outside enclosure;

a first double-walled door leading through said outside and inside walls, to provide access from said airlock to a contaminated area; and a second double-walled door leading through both said outside and inside walls to provide access from said airlock to a non-contaminated area.

2. The airlock and entry system of claim 1 wherein said means connected to said outside wall comprises:

at least one clean air intake connected to the top of said outside wall; and at least one contaminated air discharge duct connected to the bottom of said outside wall.

3. The airlock and entry system of claim 2 wherein said inner enclosure has a plurality of perforations in said inside wall, said inside ceiling and said inside floor, in order to facilitate clean air flow from said clean air intake into said inside ceiling and said inside wall and down through said inside enclosure of said airlock and to facilitate contaminated air flow out said opening in said inside floor and out said contaminated air discharge duct.

4. The airlock and entry system of claim 3 wherein said first double-walled door is directly opposite said second double-walled door.

5. The airlock and entry system of claim 4 wherein both said double-walled doors are made of folding fabric.

6. The airlock and entry system of claim 4 wherein both said double-walled doors are made of fabric and comprise a rigid framework which is spring-biased to snap shut.

7. The airlock and entry system of claim 4 wherein both said double-walled doors are made of a stiff material.

8. The airlock and entry system of claim 7 wherein both said double-walled doors are made of plastic.

9. The airlock and entry system of claim 7 wherein both said double-walled doors are made of metal.

* * * * *